United States Patent [19]

Smidek

[11] Patent Number: 4,712,652

[45] Date of Patent: Dec. 15, 1987

[54] ELEVATOR FOR TRANSPORTING PEOPLE AND GOODS WITH AN ANNULAR TRAVELLING CABIN

[75] Inventor: Otakar Smidek, Burgdorf, Switzerland

[73] Assignee: Von Roll AG., Gerlafingen, Switzerland

[21] Appl. No.: 839,953

[22] Filed: Mar. 17, 1986

[30] Foreign Application Priority Data

Mar. 22, 1985 [CH] Switzerland ..... 1287/85
Nov. 21, 1985 [CH] Switzerland ..... 4969/85

[51] Int. Cl.[4] ..... B66B 9/00; A63G 1/00

[52] U.S. Cl. ..... 187/1 R; 187/6; 272/7; 272/40

[58] Field of Search ..... 187/7, 6, 1 R, 16, 20; 272/7, 40; 104/246, 245

[56] References Cited

U.S. PATENT DOCUMENTS 474,220 5/1892 Crowe ..... 272/7
693,968 2/1902 Hinchcliffe ..... 272/7
750,140 1/1904 Welsh ..... 272/7
799,986 9/1905 Jones ..... 272/7
1,167,650 1/1916 Nachtigall ..... 272/40 X
1,454,760 5/1923 Neary ..... 104/246
1,686,298 10/1928 Uhl ..... 272/7 X
1,712,340 5/1929 Fankhouser et al. ..... 272/7
3,633,904 1/1972 Kojima ..... 272/7
3,871,300 3/1975 Perrott ..... 104/246 X
4,056,064 11/1977 Bottomley ..... 104/246 X

*Primary Examiner*—Robert J. Spar
*Assistant Examiner*—Jay I. Alexander
*Attorney, Agent, or Firm*—Bachman & LaPointe

[57] ABSTRACT

The travelling cabin comprises a plurality of closed, individual cabins, whereof the chassis is movably supported on a circular rail. The cabins are interconnected by upper and lower coupling rods. For the rotary movement of the cabins, the cage is provided with a cabin rotary drive constructed as a friction gear and whose driving wheel cooperates with a drive ring fixed to the cross-members of the cabins and which is supported by mating wheels. By subdividing the travelling cabin into individual cabins, the transportation capacity can be increased compared with comparable known travelling cabins, while the cabin weight and elevator driving power can be reduced.

19 Claims, 7 Drawing Figures

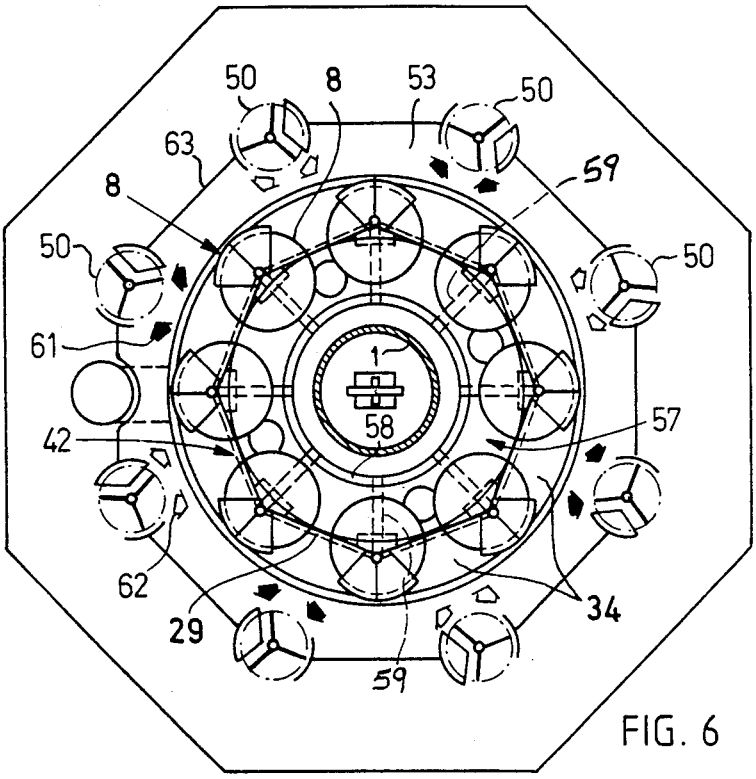
FIG. 6
FIG. 7
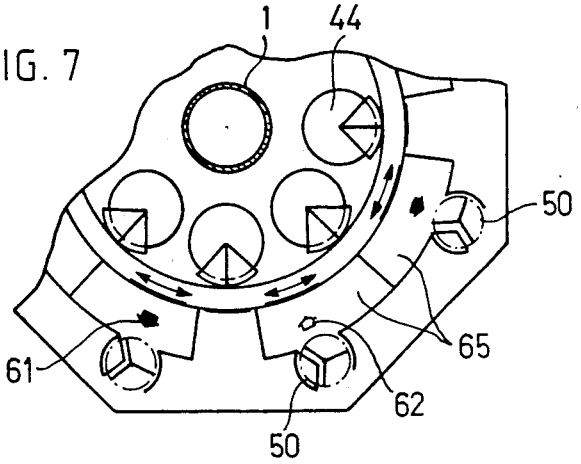

ELEVATOR FOR TRANSPORTING PEOPLE AND GOODS WITH AN ANNULAR TRAVELLING CABIN

BACKGROUND OF THE INVENTION

The present invention relates to an elevator or lift for transporting people and goods with an annular travelling cabin arranged around the outer circumference of a building, the elevator being equipped with a drive for the raising and lowering movement of the cage and a drive for a rotary movement of the cabin about the building axis.

Various constructions of such elevators or lifts are known and are designated by the term panorama lift. In one known construction, the cabin is constructed as a ring cabin, which surrounds the tower or column with one or two seating planes. The passengers sit with their backs to the cabin rotation axis on a circular seat. For each seating plane an entry door is provided and remote therefrom is positioned an exit door. This known cabin construction suffers from certain disadvantages. If it is borne in mind that, as in a conventional elevator, in roughly four minutes thirty passengers have to enter through the entry doors into the cabin and just as many people have to get out through the exit doors, then this can only be achieved with a ring cabin by taking special measures. The juxtapositioning of the seats leads to the seat-seeking passengers having to walk around in a circle, so that the cabin must have sufficiently large dimensions to permit such movements. However, this leads to a higher cabin weight and consequently to a higher elevator drive power.

SUMMARY OF THE INVENTION

It is the object of the present invention to construct an elevator and particularly its travelling cabin of the aforementioned type such that a much better passenger flow and consequently shorter entry and exit times are achieved, while simultaneously reducing the cabin weight and, therefore, the power of the elevator drive.

The foregoing object is achieved by way of the present invention wherein the travelling cabin comprises a plurality of individual, closed cabins, which are movably supported in juxtaposed manner on a circular track. Thus, the passenger flow is subdivided into individual partial flows, so that entry and exit with respect to each cabin can take place at the same time and therefore a shorter total time is required.

BRIEF DESCRIPTION OF THE DRAWINGS

The invention is described in greater detail hereinafter relative to non-limitative embodiments and the attached drawings, wherein show:

FIG. 6 is a diagrammatically represented horizontal section of the elevator of FIG. 5.

FIG. 7 is a diagrammatically represented plan view of an elevator according to FIG. 5 with means for the unimpeded inflow and outflow of passengers placed on the ground station platform.

DETAILED DESCRIPTION

The invention is based on the idea that the weight of a ring cabin of a known elevator can be reduced, if the single cabin is replaced by a plurality of individual, closed cabins, which are also arranged in ring-like manner around a building. The research carried out in connection therewith has surprisingly revealed that this leads to considerable savings regarding the weight of the cabin and the surrounded volume when using the type of construction shown in FIGS. 1 and 2.

Figure 1:
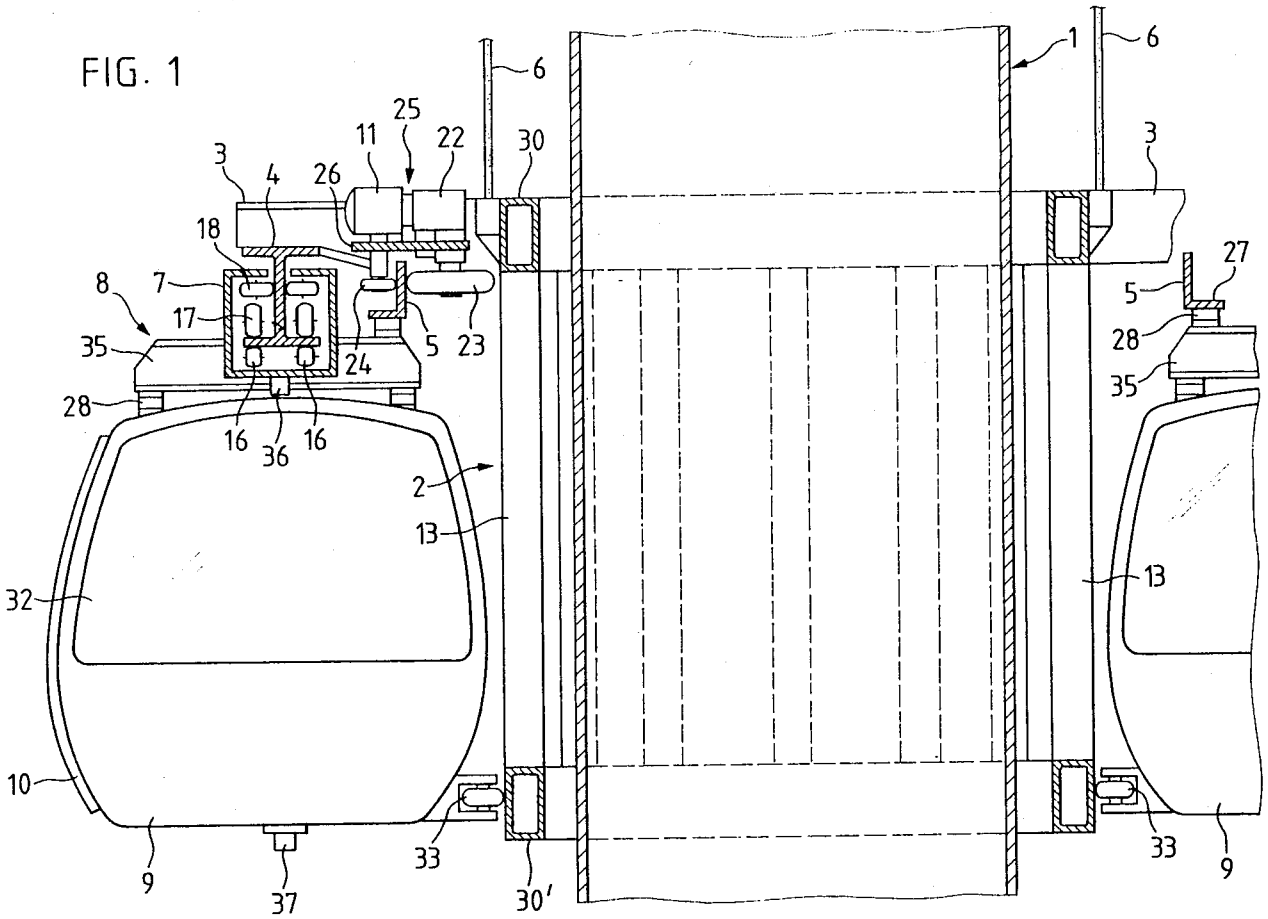
FIG. 1 is a side view, partly in section, of the cage and travelling cabin of an elevator on a tower or column, the cage and cabin being rotatable in circular manner around the tower or column and said cabin is rotatable and comprises a plurality of independent individual cabins.
Figure 2:
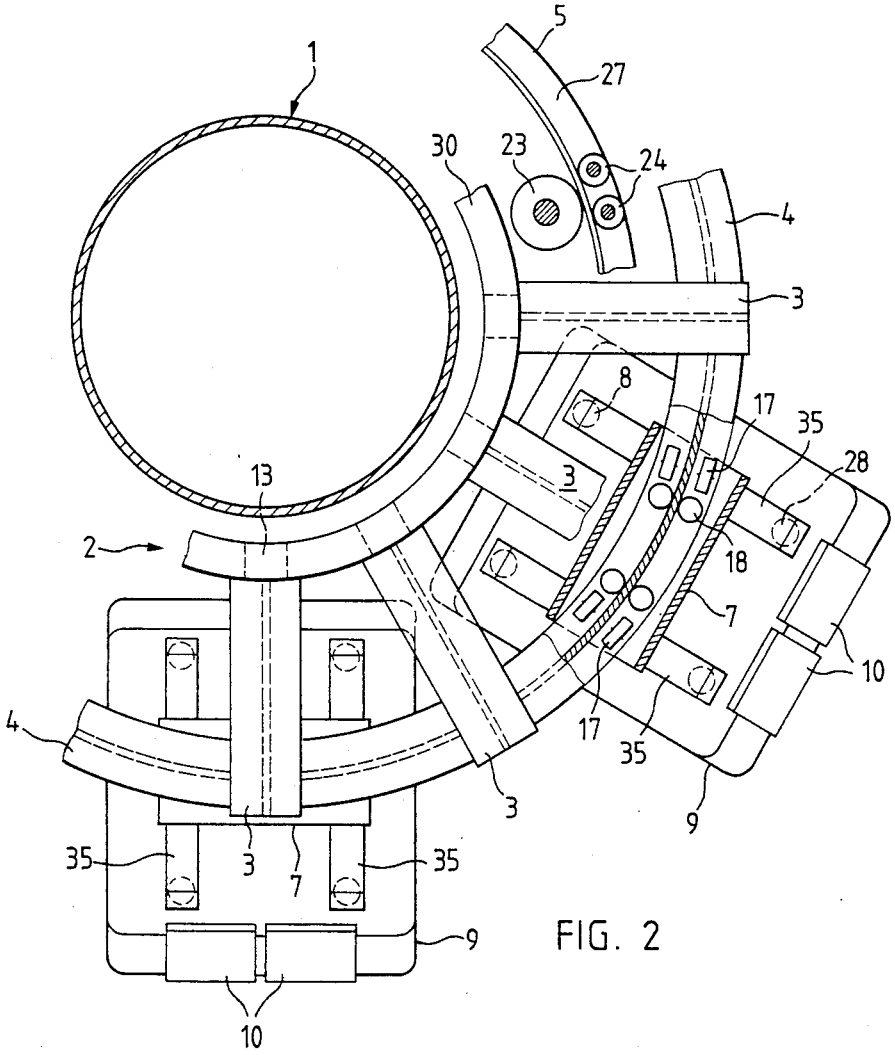
FIG. 2 is a plan view of the travelling cabin and the cage according to FIG. 1.

FIGS. 1 and 2 show a building 1 constructed as a column and whose top is reachable by an elevator. The elevator has a cage 2 with two cage rings shaped from a rolled section, namely an upper cage ring 30 and a lower cage ring 30', which are interconnected by a plurality of struts 13, which are also in the form of rolled sections. Radially projecting brackets 3 are fixed to the cage ring 30 and constitute supports for a circular rail 4, which extends in circular manner around the column 1.

Cabins 9 are movably suspended on the circular rail 4 by a suspension gear and can be moved along a circular path around the column 1. The suspension gear comprises two, approximately parallel cross-members 35 extending over the cabin roof and to which the cabins 9 can be connected by elastic connecting links 28, as well as a chassis 7 fixed by its ends to said cross-members 35. In the cavity of chassis 7 are mounted in rotary manner upper travelling rollers 17, lower travelling rollers 16 and guide rollers 18. Rollers 16, 17, 18 permit the guided movement of cabins 9 along the circular rail 4.

As can be gathered from FIG. 2 in each case two roller pairs are arranged in spaced manner in the chassis 7 connecting the two cross-members 35, i.e. in each case two upper and lower rollers 16, 17 are combined to form a roller group with two guide rollers 18, whereof one group is arranged at each end of the chassis 7. As a result of this arrangement, the cabins 9 are always kept in the same radial alignment on the circular rail 4.

The movable mounting of cabins 9 permits a circular movement about column 1. For this purpose a cabin travelling gear 25 is provided, which is designed independently of the elevator drive. The cabin travelling gear 25 is fixed to the cage 2, that is, to one of the brackets 3 and comprises an electric motor 11, preferably a brake motor, as will as a reduction gear 22. A driving wheel 23, such as a pneumatically tired wheel is fixed to the vertically downwardly directed driven shaft of reduction gear 22 and said wheel cooperates with a drive ring 5 mounted on cross-members 35. Driving wheel 23 and drive ring 5 together form a friction gear, which is also equipped with mating wheels, in order to ensure contact between ring 5 and wheel 23. The cabin travelling gear 25 is mounted on a base 26 which, as shown in FIG. 2, is fixed in the vicinity of one of the brackets 3 and the upper cage ring 30.

Drive ring 5 has a flange 27, to which are fixed preferably elastic connecting links 28, whereof in each case two links are secured to the cross-members 35 of cabins 9 and consequently carr along the latter on rotating drive ring 5.

Cabins 9 are coupled together at the bottom and top. For this purpose, there is preferably in each case one elastic coupling rod 37 on the bottom of the cabin and a further elastic coupling rod 36 at the ends of the chassis 7, so that the cabins 9 form a cohesive union. Cabins 9 are preferably constructed as lightweight shell structures. They can be given large window surfaces 32, so that optimum viewing is possible during the journey.

In order to increase stability, the cabins 9 are provided at the bottom with support rollers 33, which have a vertical rotation axis and which roll on the lower cage ring 30'. The size of the cabins 9 can be chosen as a function of the operating conditions, it being possible to use cabins with six to eight or even more passengers. The seats in cabins 9 can be arranged in U-shaped manner. On the outside of each cabin 9 is provided a door 10 for passenger entry and exit, whose opening and closing is centrally controlled and which is locked during the journey.

Important advantages result from the previously described travelling cabin constituted by several closed individual cabins. On comparing a known ring cabin for approximately sixty passengers with a cabin according to the present invention, the following results are obtained:

| | Ring Cabin | Individual Cabins |
|---|---|---|
| Passengers | 1 | 1 |
| Cabin weight | 1 | 0.5 |
| Cabin height | 1 | 0.3 |
| Elevator drive power | 1 | 0.7 |
| Transportation capacity | 1 | 1.6 |

This comparison clearly shows the advantages achievable by the cabin of the present invention.

The cage 2 is carried by two elevator cables 6, each of which can comprise a plurality of individual cables. A counterweight necessary for the elevator can, for example, be housed in column 1. The elevator drive is appropriately housed at the top of the column 1.

Figure 3:
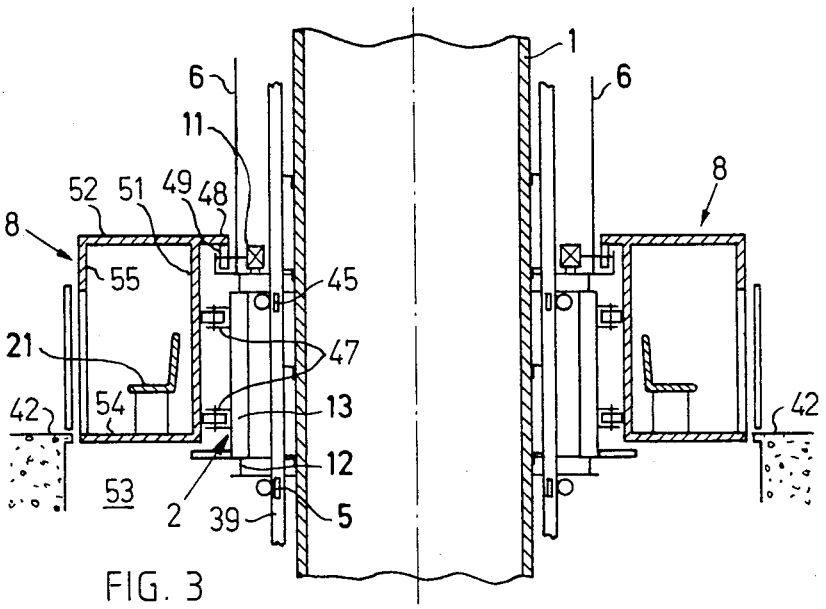
FIG. 3 is a diagrammatically represented longitudinal section of an elevator according to a first embodiment.
Figure 4:
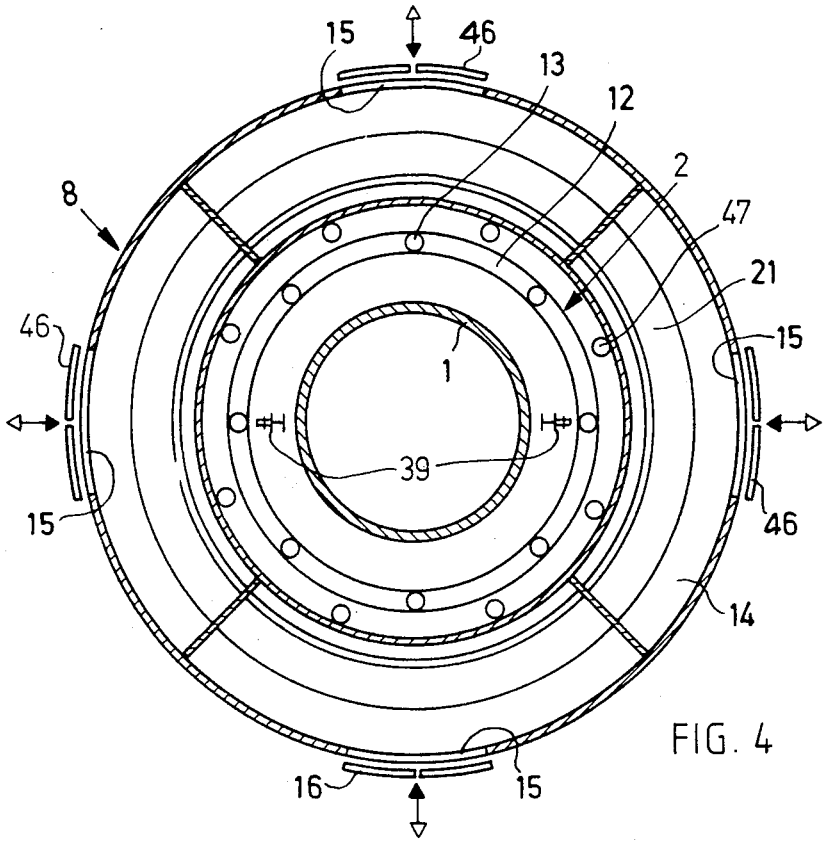
FIG. 4 is a diagrammatically represented horizontal section of the elevator of FIG. 3.

The elevator diagrammatically shown in FIGS. 3 and 4 is arranged in annular or circular manner around a building 1, for example, in the form of a tower or column with a circular cross-section. parallel to the axis of building 1 and around the circumference thereof are fixed guide rails 39, which serve to guide the cage 2 and which are provided with guides 45, such as rollers or sliding shoes for the guidance thereof. Cage 2 is suspended on elevator cables 6 with the aid of which the cage can be moved up and down.

Vertically oriented guide rollers 47 are provided on the outer circumference of cage 2 and are used for horizontally guiding the travelling cabin 8 supported on the cage. The latter also carries further support rollers 49, on which the cabin 8 is supported by means of a support flange 48. With the aid of guide rollers 47 and support rollers 49, a rotary movement can be imparted to cabin 8. For this purpose one or more support rollers 49 is equipped with a motor drive 11, e.g. an electric geared motor, which is mounted on cage 2. The latter is provided with two cage rings 12 arranged in spaced manner and shaped from a rolled section and which are interconnected by several struts 13.

The travelling cabin 8 is essentially constructed as a ring cabin and appropriately comprises several ring segments 14. In FIG. 3, four ring segments 14 are interconnected, whereof each has a door opening 15 with a cabin door 46.

The interior of travelling cabin 8 is formed by an inner wall 51, an outer wall 55, a top cover 52 and a bottom surface 54. Cabin 8 is guided in the horizontal direction by the inner wall 51 supported on guide rollers 47 and is guided in the vertical direction by the top cover 52 with the support flange 48. The interior of cabin 8 is equipped with a circular seat 21 for the passengers. The outer wall 55 is at least partly constructed as a transparent wall.

FIG. 3 shows the travelling cabin 8 in the bottom position, that is, at the ground station. A platform 42 is aligned with the bottom of the cabin 8 and is used for the entry and exit of passengers into or out of cabin 8. Platform 42 forms part of the foundation, which has a depression 53, into which is partly introduced the cage 2 with the travelling cabin 8, while on the bottom of depression 53 is supported the building 1, that is the tower or column.

Figure 5:
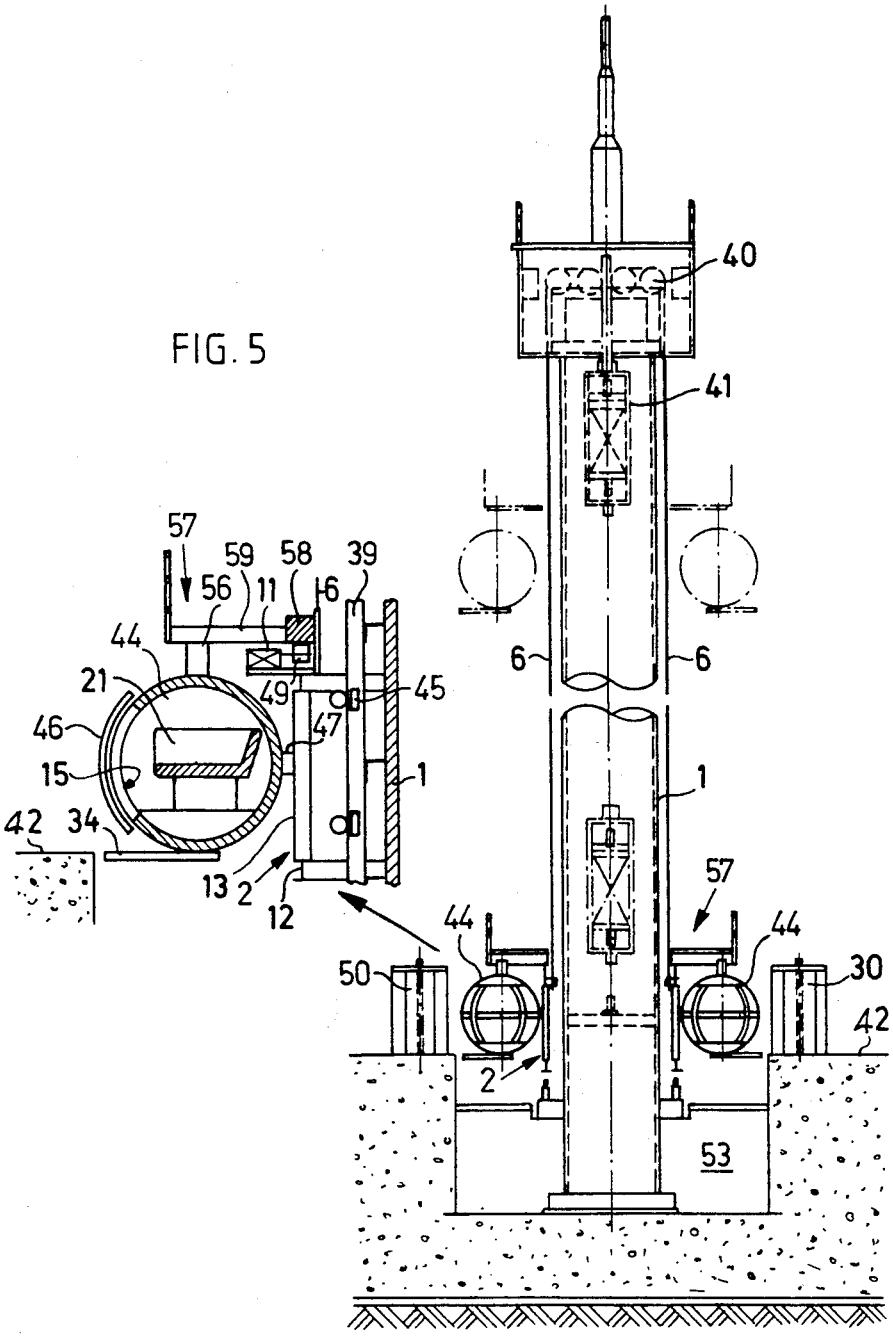
FIG. 5 is a diagrammatically represented longitudinal section through an elevator according to a second embodiment.

With reference to the elevator shown in FIGS. 5 and 6, the same reference numerals as in FIGS. 1 and 2 designate the same parts. As in the case of the elevator of FIGS. 3 and 4, travelling cabin 8 extends in an annular manner around the building 1, but comprises a plurality of closed, individual cabins 44. In the embodiment according to FIGS. 5 and 6, the cabins 44 have a spherical construction, but it is also possible to use another cabin shape, such as parallelepipedic or the like. As shown in FIG. 5, the seat 21 for the passengers is appropriately constructed in U-shaped manner in the closed cabins 44.

Each cabin 44 is attached by means of a suspension gear 56 to a merry-go-round 57, which is essentially a circular platform, which is constructed as a framework. FIG. 5 shows that the merry-go-round 57 essentially comprises an inner ring 58, several radial supports 59 and the connecting supports 29 connecting the free ends of the radial supports 59. However, supports 29 and 59 can also be arranged differently, that is, in such a way that the merry-go-round 57 forms a star constituted by the supports and which has a number of arms or beams corresponding to the number of cabins 44. The merry-go-round 57 is supported in rotary manner on support rollers 49, whereof at least one roller 49 is provided with a motor drive 11 for producing a rotary movement of the cabins. Cabins 44 are also supported by guide rollers 47 on cage 2, so that the cabins are guided both vertically and horizontally.

The cables 6 of the presently described elevator are guided over the upper station by means of deflector rollers 40 and connected with a counterweight 41 in the interior of the building. At least two cables 6 are required for an elevator.

The passenger flow in the stations is organized in accordance with the annular arrangement of cage 2. In FIGS. 5, 6 and 7, for in each case two cabins 44 locks 50 are provided, which are appropriately constructed as one-way locks. Locks 50 indicated by arrows 61 are exit locks, while those indicated with arrows 62 are entrance locks. In accordance with the eight cabins 44 used in the elevator according to FIG. 6, eight locks 50 are required, in each case half being entrance and exit locks. Passage between the individual locks 50 is made impossible by fence barriers 63.

In order to improve access to an exit from the cabins 44, a rotary ramp 34 is provided on the bottom of the cabin 44 and also serves to connect the individual cabins. If the cabins 44 are at the ground station, the rotary ramp 34 is aligned with platform 42.

In the organization of the passenger flow according to FIG. 7, there are waiting rooms 65 between the locks 50 and the passengers can be collected therein in order to separate the entering and exiting passengers. In addition to the locks 50, further means can be provided for ensuring a smooth passenger flow, such as, constrained passages and deflecting means, so that the corresponding number of passengers for one or two cabins 44 can be separately collected.

It falls within the scope of the invention to provide the travelling cabin 8 shown in FIGS. 3 and 4 with two or more floors or levels in order to increase the transportation capacity. To achieve a favorable passenger flow, in this case two entrance/exit platforms are required.

A merry-go-round is also provided for the travelling cabin 8 according to FIGS. 3 and 4. The difference compared with the construction according to FIGS. 5 and 6 is that in FIGS. 3 and 4 the merry-go-round 48, 52 is part of the travelling cabin.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An elevator system for a building comprising:

a cage arranged around the outer circumference of said building, said cage having an upper cage ring and a lower cage ring interconnected by struts, and a supporting track;

first drive means associated with said cage for selectively raising and lowering same;

a plurality of closed, independent travelling cabins vertically supported on said supporting track in a juxtaposed manner by rollers having a substantially horizontal axis and horizontally supported on said cage by rollers having a substantially vertical axis; and second drive means associated with said at least one travelling cabin for moving same on said cage around said building.

2. An elevator system according to claim 1 wherein said track is formed by a rail on which the cabins are supported by means of a chassis, said rail being connected to said cage by a plurality of radially extending brackets.

3. An elevator system according to claim 1 wherein said second drive means for the movement of the cabins is arranged on a base which is firmly supported on said cage.

4. An elevator system according to claim 3 wherein said second drive means for the rotary movement of the cabins comprises a friction gear having a driving wheel which cooperates with a drive ring, said drive ring extends around said building and is coupled to said cabins.

5. An elevator system according to claim 1 wherein said cabins are interconnected by coupling rods, said coupling rods comprising lower coupling rods located in the vicinity of the bottom of the cabin and upper coupling rods located in the vicinity of the top cover of the cabin.

6. An elevator system according to claim 7 wherein said radially extending brackets are connected to said upper cage ring.

7. An elevator system according to claim 2 wherein said lower cage ring is provided with a rolling surface on which the rollers for horizontally supporting said cabins rotate.

8. An elevator system according to claim 1 wherein the travelling cabins are constructed as a ring cabin having four door openings diametrically facing one another in pairs wherein one pair is for entrance platform and one pair is for exit platform.

9. An elevator system according to claim 8 wherein the travelling cabins comprise individual compartments which are suspended by means of a suspension gear on a merry-go-round.

10. An elevator system according to claim 1 wherein the track comprises rollers with a horizontal rotation axis, which rotate while the travelling cabin is horizontally supported on guide rollers which rotate.

11. An elevator system according to claim 1 wherein said supporting track is connected to the cage by brackets and the cabins are suspended from said supporting tracks by a suspension gear.

12. An elevator system according to claim 11 wherein said lower cage ring is provided with a rolling surface on which the rollers for horizontally supporting said cabins rotate.

13. An elevator system according to claim 12 wherein said cabins are interconnected by coupling rods.

14. An elevator system according to claim 13 wherein said second drive means for the movement of the cabins is arranged on a base which is firmly supported on said cage.

15. An elevator system according to claim 1 wherein the cabins are provided with a horizontal support flange extending from the top cover thereof, said horizontal support flange having guide rollers driven by said second drive means.

16. An elevator system according to claim 15 wherein said cage is provided with a rolling surface on which the rollers for horizontally supporting said cabins rotate.

17. An elevator system according to claim 1 including a merry-go-round having an inner ring, a plurality of radial supports radiating from said inner ring and having free ends and connecting supports connecting the free ends of said radial supports wherein said cabins are supported from said merry-go-round.

18. An elevator system according to claim 17 wherein said inner ring is supported on vertical rollers driven by said second drive means.

19. An elevator system according to claim 1 wherein the building is provided with longitudinal guide rails for guiding the cage.

* * * * *